US009151499B2

(12) United States Patent
Ratosa et al.

(10) Patent No.: US 9,151,499 B2
(45) Date of Patent: Oct. 6, 2015

(54) GLOW PLUG WITH A LOAD SENSING SLEEVE SURROUNDING A HEATING ROD

(75) Inventors: Gverino Ratosa, Ankaran (SI); Rudi Kragelj, Tolmin (SI)

(73) Assignee: HIDRIA AET d.o.o., Tolmin (SI)

( * ) Notice: Subject to any disclaimer, the term of this patent is extended or adjusted under 35 U.S.C. 154(b) by 836 days.

(21) Appl. No.: 13/307,284

(22) Filed: Nov. 30, 2011

(65) Prior Publication Data

US 2012/0160821 A1 Jun. 28, 2012

(30) Foreign Application Priority Data

Dec. 22, 2010 (EP) ..... 10196601

(51) Int. Cl.
*F23Q 7/00* (2006.01)

(52) U.S. Cl.
CPC ..... *F23Q 7/001* (2013.01); *F23Q 2007/002* (2013.01)

(58) Field of Classification Search
CPC ..... F23Q 7/00; F23Q 7/04; F23Q 7/22; F23Q 13/00; F23Q 7/001; F23Q 2007/002; H05B 3/02; H05B 3/08
USPC ..... 219/260–270, 538, 541–553, 523; 123/143 A, 143 R, 594; 338/226
See application file for complete search history.

(56) References Cited

U.S. PATENT DOCUMENTS 4,563,568 A * 1/1986 Takizawa ..... 219/270
7,201,043 B2 4/2007 Yamada et al.
7,337,657 B2 * 3/2008 Haussner et al. ..... 73/114.18
7,444,973 B2 11/2008 Boucard et al.
7,581,520 B2 9/2009 Kern et al.
8,297,115 B2 10/2012 Borgers et al.
2001/0015402 A1 8/2001 Murai et al.
2006/0218997 A1 10/2006 Yamada et al.
2007/0095811 A1 5/2007 Last
2008/0216786 A1 9/2008 Ramond et al.
2009/0242540 A1 10/2009 Itoh et al.
2009/0320576 A1 12/2009 Borgers et al.

FOREIGN PATENT DOCUMENTS

EP 1707935 10/2006
EP 2138819 12/2009
EP 2138820 12/2009

OTHER PUBLICATIONS

European Search Report dated Jul. 7, 2011, corresponding to the Foreign Priority Application No. 10.196601.8.

* cited by examiner

*Primary Examiner* — Dana Ross
*Assistant Examiner* — Michael Laflame, Jr.
(74) *Attorney, Agent, or Firm* — Young & Thompson

(57) ABSTRACT

A glow plug includes a heating rod (11), a plug body (13) having a receiving housing (14) of the heating rod, a mounting device (48) for mounting the heating rod, permitting axial translation movements of the heating rod relative to the plug body and ensuring impermeability between the heating rod and the plug body, a load sensing sleeve (17) which extends around the proximal portion (50) of the peripheral metal tube (59, 61) of the heating rod in the proximal zone (51) of the receiving housing, directly adjoining axially the mounting device (48) axially on the proximal side.

20 Claims, 10 Drawing Sheets

13
42
45
41
12
44
51
37
54
30
38
36
35
34
17
18
33
27
53
31
23
32
55
28
22
29
16
50
15
21
19
48
20
23
52
25
39
40
14
80
46
24
26
47
64
59
11
49
69

GLOW PLUG WITH A LOAD SENSING SLEEVE SURROUNDING A HEATING ROD

BACKGROUND OF THE INVENTION

Field of the Invention

The invention concerns a glow plug, in particular for a diesel engine, including a heating rod, and an integrated load sensor which makes it possible to carry out measurements of the cylinder pressure.

A heating rod of a glow plug is in the form of a rigid rod or bar, which extends longitudinally according to an axis, called the principal axis, from the body of the plug into the combustion chamber. Throughout the text, the term "distal" and its derivatives designate directions, elements or parts which are situated axially on the side of the free extremity of the heating rod, which is intended to extend into the combustion chamber, and the term "proximal" and its derivatives designate directions, elements or parts which are situated axially on the opposite side, i.e. towards the connection towards the outside of the cylinder head of the engine on which the glow plug is intended to be fitted.

A heating rod also extends from the proximal side into the plug body, and has a proximal extremity which is equipped with an electrical connection which forms a first electrical power supply terminal of the heating rod, in general with an electrode which extends axially beyond the proximal extremity of the heating rod. Throughout the text, a heating rod power supply electrode, when it is provided, is not considered to form an integral part of the heating rod itself. Consequently, the proximal extremity of the heating rod is distinct from the proximal extremity of the power supply electrode, when the latter is provided.

The plug includes a cylindrical plug body having a threaded external portion for fitting on a cylinder head, and forming a cylindrical internal housing for receiving a proximal portion of the heating rod extending from said proximal extremity, said housing having an opening for the passage of the heating rod such that the latter extends axially, projecting (on the distal side) beyond said proximal portion and the opening, and having a heating distal portion as far as the distal extremity of the heating rod.

The heating rod is either in the form of a ceramic bar which is machined to shape and set (fixed by brazing or inserted by force (bracing)) into a peripheral metal tube to be fitted into the plug body; or in the form of a metal tube which is closed at its distal extremity, of standardised invariable dimensions (this metal tube receiving a electrical power supply electrode). Whatever the embodiment, the heating rod therefore always includes a peripheral metal tube. The exterior diameter of this peripheral metal tube is, in the proximal portion of the heating rod which extends into the plug body, at least approximately constant, and according to the standards, must equal 4 mm.

The plug also includes a device for mounting said proximal portion of the heating rod in said receiving housing, this mounting device being able to:

- permit axial translation movements of the heating rod relative to the plug body, so that the cylinder pressure can be measured,
- ensure impermeability between the heating rod and the plug body, in such a way as to delimit a proximal zone of the receiving housing which is not exposed to the atmosphere of the combustion chamber,
- be compatible with and/or providing the various electrical links to the heating rod and the load sensor.

Integrating such a load sensor into a glow plug for cylinder pressure measurements raises numerous contradictory and unresolved problems. In particular, the sensor must not be exposed to the atmosphere of the combustion chamber, or subjected to the very high temperatures which are found there, and are likely to cause its destruction, or at least to interfere seriously with its functioning; but it must be capable of being housed in the plug, in which the available space is at least reduced; and the functioning of the sensor must be reliable, i.e. produce signals which represent the cylinder pressure without interference (e.g. by vibration phenomena, damping, differential thermal expansion, etc.).

DESCRIPTION OF THE RELATED ART

Various solutions have been proposed for integrating a load sensor into a glow plug.

In a first known solution (e.g. see U.S. Pat. No. 7,444,973), for reasons of radial space requirement, the load sensor is placed at the proximal extremity of the electrical power supply electrode of the heating rod, i.e. outside the cylinder head, in a position which is axially distant from the heating rod itself, and which can even be considered as being outside the glow plug. This solution has the major disadvantage of interfering with the measurement, because of deformation of the cylinder head and plug body (in their portion which extends facing the electrode). The deformation modes of the cylinder head vary from one engine to another, so that the load sensor cannot be calibrated absolutely. Additionally, the length of the kinematic linkage between the heating rod, which is subject to pressure loads in the combustion chamber, and the sensor generates normal vibration modes in the pass band of the sensor, which are likely to hamper its functioning.

In a second known solution (e.g. see U.S. Pat. No. 7,581,520, US 2009/0242540), the sensor is in the form of a sleeve surrounding the electrical power supply electrode or a prolongation rod, beyond the proximal extremity of the heating rod, and an elastic deformable flexible impermeability membrane is provided to link the distal portion of the heating rod to the plug body, in such a way as to provide impermeability and to allow axial translation movements. Consequently, the sensor is relatively well insulated thermally from the combustion chamber. But its mechanical linkage to the heating rod necessitates particularly complex peripheral mounting parts, thus causing, on the one hand, mechanical impedance (and thus possible interfering normal modes), and on the other hand problems of differential thermal expansion, which are relatively complex to solve.

In a third known solution (e.g. see US 20080216786, EP 2138819), which is limited to cases of a heating rod with a ceramic bar, the sensor is placed directly against the proximal extremity of the heating rod. This solution makes a more direct connection between the heating rod and the sensor possible, but then raises the problem of the space requirement of the sensor and its interference with the electrical connection elements of the heating rod (electrode). Additionally, the problems associated with the normal modes of the assembly unit (plug body/heating rod/sensor/plug body) and the differential thermal expansion remain. In this context, it should be noted that the length of a heating rod is typically of the order of 50 mm (for a diameter of 4 mm). Finally, this solution is incompatible with a so-called all-metal heating rod, that is one in the form of a metal tube.

Additionally, integration of the load sensor into the heating rod itself, even if it is theoretically possible in the case of a heating rod with a ceramic bar (between the bar and the peripheral metal tube, see US 20070095811), is impossible in practice, on the one hand because the sensor would then necessarily be exposed to the atmosphere and the extreme temperatures (of the order of 1200° C.) of the combustion chamber, and on the other hand because it would require joint manufacture and certification of the heating rod and the sensor, which are complex components which are made by different suppliers and require different skills, and finally because it raises problems, which have not been resolved, in the assembly and electrical connection of the sensor. Additionally, in this case too, this solution is incompatible with an all-metal heating rod (in the form of a metal tube and an internal metal electrode).

BRIEF SUMMARY OF THE INVENTION

The invention is thus aimed at overcoming these disadvantages of the prior art, by proposing a glow plug which includes a load sensor, and in which:

- the load sensor supplies signals representing the cylinder pressure, with no interference from the characteristics of the mechanical link between the sensor and, on the one hand, the heating rod, and, on the other hand, the plug body, in the largest possible pass band, which in particular can exceed 8 kHz,
- the load sensor is isolated from the atmosphere of the combustion chamber, and not exposed to its extreme temperatures,
- the assembly of the unit is not subject to differential thermal expansion, which is likely to interfere with the good functioning of the glow plug or the quality of the signals which the sensor supplies,
- the load sensor is not integrated within the heating rod itself, so that it does not affect the lifetime and reliability of the latter,
- the sensitivity of the load sensor is optimised, so that the signals which the latter supplies make it possible to detect pressure variations of relatively small values (with the aim of making it possible to detect better the different phases of variations of pressure, irrespective of the engine model or its speed, and thus making possible finer control of the engine by the electronics which process these signals),
- the electrical connections of the heating rod on the one hand, and of the load sensor on the other hand, can be implemented in a simple, reliable manner.

To this end, the invention concerns a glow plug comprising:

- a heating rod comprising a peripheral metal tube, and having an extremity, called the proximal extremity, which is equipped with an electrical power supply connection of the heating rod,
- a plug body, forming a housing, called a receiving housing, receiving the heating rod, the latter having a distal portion which extends axially, projecting beyond the plug body,
- a mounting device for mounting the heating rod in said receiving housing, this mounting device being arranged to:
- permit axial translation movements of the heating rod relative to the plug body, and
- ensure impermeability between the heating rod and the plug body, in such a way as to delimit a proximal zone of the receiving housing which is not exposed to the atmosphere of a combustion chamber of an engine which receives the glow plug,
- a load sensing sleeve which extends entirely in said proximal zone of the receiving housing, said load sensing sleeve being tubular and having:
  - a first axial extremity, which is connected to the heating rod so as to be driven in axial translation by the movements of the latter in at least one direction, called the proximal direction, in which the heating rod tends to re-enter the interior of the plug body, and
  - a second axial extremity, opposite the first axial extremity, this second axial extremity being connected to the plug body in such a way that the axial translation movements of the heating rod relative to the plug body generate axial compression and/or traction stresses in said load sensing sleeve, characterized in that said tubular load sensing sleeve extends around a portion, called the proximal portion, of the peripheral metal tube of the heating rod which also extends in said proximal zone of the receiving housing, and in that the tubular load sensing sleeve directly adjoins the mounting device axially on the proximal side.

In a plug according to the invention, the load sensing sleeve is tubular and extends around a proximal portion of the peripheral metal tube of the heating rod, corresponding to a section of constant diameter—in particular of maximum diameter—(standardised value 4 mm) of the peripheral metal tube of the heating rod.

Thanks to the invention, the position of the load sensor relative to the heating rod minimises, or even suppresses, all the problems of mechanical (interference with the plug body by deformation of the cylinder head, interfering normal modes) or thermal (differential thermal expansion) connections. Nevertheless, the load sensor is not exposed to the atmosphere of the combustion chamber or its extreme temperatures. It is noticed in practice that in a plug according to the invention, the load sensing sleeve can be subject to temperatures not exceeding 170° C., which is still perfectly acceptable.

Additionally, in a glow plug according to the invention, the actual function of the load sensor, taking account of its specific shape and position, is to detect shear stresses in the mechanical assembly between the heating rod and the plug body. This detection is done by transforming shear loads into axial loads (i.e. parallel to the axis of the sleeve) of compression and/or traction, said transformation being strictly linear, and not causing linearity faults. The result is that the detection is linearly geared down, and the general sensitivity of the sensor is improved.

Equally, the invention is as compatible with a heating rod with a ceramic bar as with a heating rod in the form of a metal tube, and a glow plug according to the invention can be used almost universally on any engine, the sizing of the load sensor being ensured by construction.

Thus, according to a first variant embodiment, advantageously and according to the invention, the heating rod being formed of a ceramic bar which is set in a peripheral metal tube, said load sensing sleeve extends around the proximal portion of the peripheral metal tube of the heating rod. According to a second variant embodiment, advantageously and according to the invention, the heating rod being essentially in the form of a metal tube, said load sensing sleeve extends around the proximal portion of this metal tube. In particular, in a glow plug according to the invention, the load sensing sleeve does not extend entirely around the electrical power supply electrode of the heating rod, but around a proximal portion (of constant diameter equal to 4 mm) of the peripheral metal tube of the heating rod itself. Not only does that turn out to be possible in practice (despite the little available radial space), but on the contrary, it makes it possible to obtain important advantages.

Additionally, the proximal extremity of the heating rod remains entirely accessible and available, on the one hand for the electrical connection, and on the other hand for optimised mechanical assembly, e.g. to incorporate damping elements.

In a glow plug according to the invention, the load sensor adjoins axially, on the proximal side, the mounting device of the heating rod relative to the plug body, and the inventors have noticed that the invention makes possible, simultaneously, optimal guidance of the heating rod and setting up electrical connections, which are likewise optimal and incorporate screening.

The invention is also compatible with a position of the impermeability member of the mounting device nearest the combustion chamber, which makes it possible to avoid clogging the proximal portions of the plug with carbon deposit from the combustion chamber.

Additionally, the inventors have noticed that it is possible in practice to define a way of mounting the load sensing sleeve, mechanically and electrically, which is compatible with the (standard) general radial dimensions of a glow plug. Thus, in particular, in a glow plug according to the invention, said mounting device includes a mounting bush which is fixed in said receiving housing and around said proximal portion of the peripheral metal tube of the heating rod, and the load sensing sleeve is carried by said mounting bush. The load sensing sleeve prolongs axially the mounting bush of the proximal side.

Advantageously, a glow plug according to the invention is also characterized in that the mounting bush has a first fixing face which is fixed rigidly and impermeably (i.e. via impermeable fixation means) to an internal wall facing the receiving housing, and a second fixing face which is fixed rigidly and impermeably (i.e. via impermeable fixation means) around said proximal portion of the heating rod, and in that said first and second fixing faces of the mounting bush at least partially face each other radially. Preferably, advantageously and according to the invention, said load sensing sleeve extends axially beyond said fixing faces of the mounting bush, towards the proximal extremity of the heating rod. The result, in particular, is that the load sensing sleeve supplies signals representing shear loads between these two fixing faces of the mounting bush. Also, deformation of the cylinder head or plug body does not interfere with detection by the load sensing sleeve. Additionally, when the temperature of the heating rod rises, a flow of heat may be established radially in the mounting bush between the two fixing faces, which allows an efficient transmission of calories to the cylinder head, so that the other elements of the glow plug, including the load sensing sleeve, are less subject to extreme temperatures.

Additionally, advantageously and according to the invention, said first axial extremity of the load sensing sleeve is a distal extremity of the latter, and said second axial extremity of the load sensing sleeve is a proximal extremity of the latter.

In particular, advantageously and according to the invention, the mounting bush includes a linking tube which surrounds the load sensing sleeve and links said second axial extremity of the load sensing sleeve to said first fixing face. The result is that the load sensing sleeve rests on the heating rod and on the plug body respectively in zones which at least approximately face each other radially, and thus detects the shear loads between these two zones. Also, it should be noted that said first axial extremity of the load sensing sleeve is situated in a more proximal position than said first fixing face.

Additionally, advantageously and according to the invention, the mounting bush includes a sleeve for receiving the heating rod which forms said second fixing face, and a fixing ring which forms said first fixing face, said receiving sleeve being guided in axial translation in the fixing ring, the receiving sleeve being connected to a distal extremity of the fixing ring. The distal extremity of the receiving sleeve is connected to the fixing ring so that it has an axial elasticity which resists the axial translation movements of the heating rod in the proximal direction, so that the load sensing sleeve is subjected to loads of absolute values which are reduced by the thus formed elastic resistance. For example, the distal extremity of the receiving sleeve is turned up on the proximal side towards the exterior, so that the thus formed turned-up part has elasticity in flexion. Also, this turned-up part is itself impermeable, the distal extremity of the receiving sleeve and the fixing ring being suitable for ensuring impermeability between the heating rod and the plug body at the distal extremity of the latter.

It should be noted that the linking tube is advantageously chosen so as to have an elasticity in axial traction which makes it possible to compensate for the variations of mechanical properties, in particular elasticity, of the distal extremity of the receiving sleeve, as a function of temperature. In practice, the result is that said linking tube can, for example, be in the form of a very fine metal tube which is implemented in an identical or similar material to that of which the receiving sleeve is made, or in any case having identical or similar variations of elasticity as a function of temperature. Advantageously and according to the invention, the linking tube is connected to a proximal extremity of the fixing ring.

Additionally, advantageously and according to the invention, the load sensing sleeve is in the form of a tubular block, and the heating rod—in particular the peripheral metal tube of the heating rod—passes axially through the mounting bush entirely, and at least partially through the load sensing sleeve. This tubular block forming the load sensing sleeve includes at least one piezoelectric washer or at least one stress gauge. The load sensing sleeve carried by the mounting bush (at the proximal extremity of the receiving sleeve and via the linking tube) is arranged for not interfering with the movements in translation of the heating rod relative to the plug body.

The invention also concerns a glow plug, which is characterized in combination by all or some of the characteristics mentioned above or below.

BRIEF DESCRIPTION OF THE DRAWINGS

Other objects, characteristics and advantages of the invention will appear on reading the following description, which refers to the attached figures, which represent embodiments of the invention as non-limiting examples, and in which.

DETAILED DESCRIPTION OF THE PREFERRED EMBODIMENTS

Figure 1:
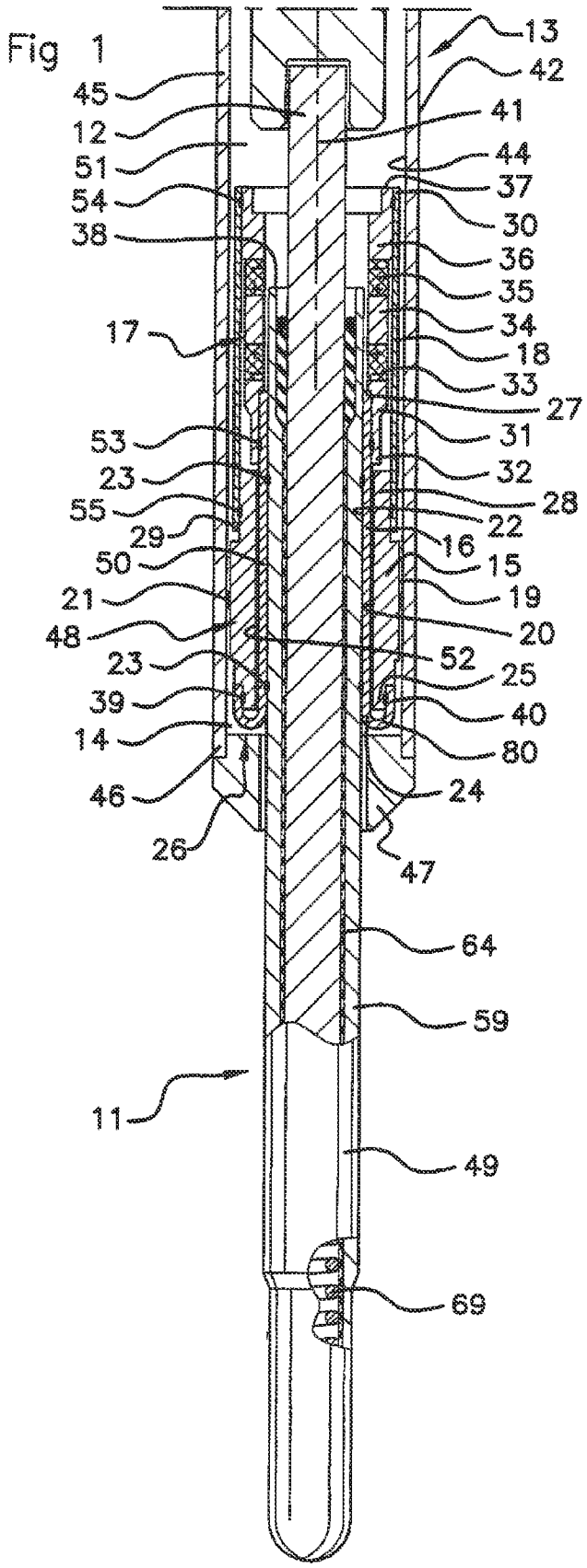
FIG. 1 is a schematic view in axial cross-section of the distal part of a glow plug according to a first embodiment of the invention.
Figure 2:
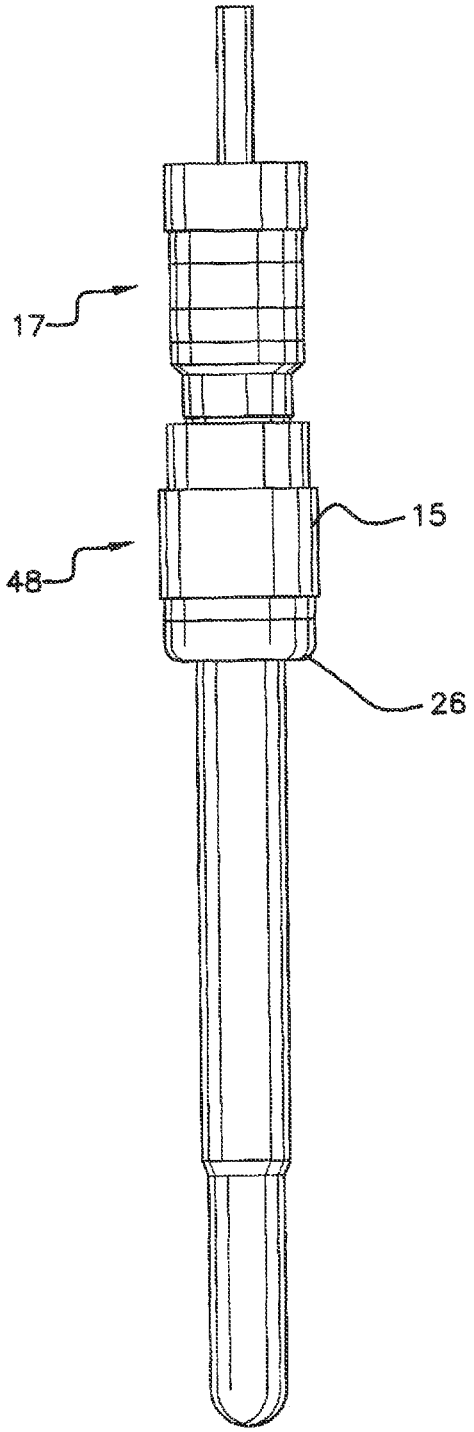
FIGS. 2 to 5 are schematic views in elevation of different stages of manufacture of a glow plug according to the first embodiment of the invention.

A glow plug according to the invention includes a heating rod 11 which, in the example of FIG. 1, is of the so-called all-metal type, consisting essentially of a metal tube 59. This metal tube 59 is thus a metal tube which can be called peripheral, and receives an electrical power supply electrode 12 (which is not considered to form an integral part of the heating rod itself), so that power can be supplied to it by a current which is capable of heating at least one electrical resistance 69 which is arranged at the distal extremity of the electrode 12 within the metal tube 59, and capable of generating (by Joule effect) heating of the distal extremity of the heating rod 11. The electrode 12 extends into the metal tube 59, on a certain length of the latter, and is insulated from it by an inserted insulating material 64. The electrode 12 extends axially in a projection beyond the proximal extremity 38 of the heating rod 11. The electrode 12 has a proximal extremity 97 which is connected to an electrical power supply connector 98. This heating rod 11 is received in a plug body 13, which for this purpose forms a receiving housing 14.

The heating rod 11 extends longitudinally according to a principal axis 41, which is also an axis of the plug body 13, of the receiving housing 14, and of a threaded portion 43 of the external wall 42 of the plug body 13, said threaded portion being configured and intended to make it possible to fix the glow plug in an internally threaded hole which passes through the cylinder head of an engine. Throughout the text, the terms "axial" and "radial" and their derivatives refer to the principal axis 41.

The plug body 13, its external wall 42, the receiving housing 14 and the internal wall 44 of the plug body 13, which delimits the receiving housing 14, is preferably rotationally symmetrical around the principal axis 41, but any other form which does not conform to such a symmetry of revolution is equally conceivable. That being so, the plug body 13, in its distal portion forming the receiving housing 14, is in the form of a tube 45, the internal wall 44 of which is cylindrical (rotationally symmetrical or not, i.e. its base is not necessarily circular) relative to the principal axis 41. This tube 45 has a distal extremity 46, which is closed by a truncated washer 47, which forms the distal extremity of the plug body 13. The receiving housing 14 thus extends from the truncated washer 47 axially in the proximal direction.

The heating rod 11 extends axially in the distal direction beyond the plug body 13 and the washer 47, through the central opening of the latter, and has a distal portion 49 which is intended to extend into the atmosphere of the combustion chamber. The heating rod 11 also has a proximal portion 50, which extends into the receiving housing 14.

The receiving housing 14 contains a mounting bush 48 of the heating rod 11. The function of this mounting bush 48 is to fix the heating rod 11 solidly relative to the plug body 13, while making slight axial translation movements of the heating rod 11 relative to the plug body 13 possible, under the effect of variations of the pressure of the atmosphere of the combustion chamber. The mounting bush 48 also includes means 15, 16 of impermeability, ensuring impermeability between the heating rod 11 and the plug body 13, in such a way as to delimit a proximal zone 51, which is not exposed to the atmosphere of the combustion chamber, of the receiving housing 14.

The mounting bush 48 includes a fixing ring 15, which is cylindrical overall and has a cylindrical wall 19, which faces radially towards the exterior and is fixed rigidly and impermeably to the internal wall 44 (which faces radially towards the interior) of the receiving housing 14, in particular by at least one peripheral weld 21, which can be implemented by laser through the thickness of the tube 45. The wall 19 of the fixing ring 15 thus forms a first fixing face of the mounting bush 48, to the internal wall 44 facing the receiving housing 14.

The fixing ring 15 has an internal cylindrical wall 20, which forms a hole which passes through the fixing ring 15 axially. The internal diameter of this internal wall 20 of the fixing ring 15 is greater than the peripheral diameter of the proximal portion 50 of the heating rod 11 facing it, so as to make a space radially for insertion of a receiving sleeve 16 between the fixing ring 15 and the proximal portion 50 of the heating rod 11.

The receiving sleeve 16 has a tubular principal part in the form of a fine metal tube. This fine metal tube is preferably of stainless steel with high characteristics, in particular having a Young's modulus greater than 150 GPa, in particular of the order of 200 GPa, an elastic limit greater than 600 MPa, e.g. of the order of 800 MPa, and a fatigue strength (maximum stress for which the number of cycles is infinite) of at least 300 MPa, e.g. of the order of 400 MPa. For example, it is of 17-4PH steel or inconel steel.

The tubular principal part of the receiving sleeve 16 has an internal cylindrical wall 22 (facing radially towards the interior), the internal diameter of which corresponds to that of the proximal portion 50 of the heating rod 11 (in particular typically of 4 mm according to the standards in force), so as to be in contact with this proximal portion 50 and fixed rigidly and impermeably to the latter by at least one peripheral weld 23 (in particular two fillets of peripheral weld in the example shown in FIG. 1). The wall 22 of the receiving sleeve 16, which is fixed rigidly and impermeably around the proximal portion 50 of the heating rod 11, thus forms a second face 22 for fixing the mounting bush 48 on the heating rod 11.

The tubular principal part of the receiving sleeve 16 has a peripheral cylindrical wall 52 which faces radially towards the exterior, i.e. facing the internal wall 20 of the fixing ring 15. A very small gap—in particular of the order of 0.2 mm—is created radially between these cylindrical facing walls 52, 20, so as to make axial translation movements of the receiving sleeve 16 relative to the fixing ring 15 possible. The receiving sleeve 16 has a distal extremity 24 which is fixed rigidly and impermeably—in particular by at least one peripheral weld 39—to the distal extremity 25 of the receiving ring 15.

The distal extremity 24 of the receiving sleeve 16 is turned up towards the exterior and the proximal side, so as to form a turned-up part 26 which passes around the distal extremity 25 of the receiving ring 15, this turned-up part 26 having a proximal extremity portion 40 which is fixed rigidly and impermeably by said peripheral weld 39 to the distal extremity of the wall 19, which faces radially towards the exterior of the fixing ring 15. Preferably, a peripheral recess is made in the face which faces radially towards the exterior of this distal extremity of the wall 19 of the fixing ring 15, to receive the proximal extremity portion 40 of the turned-up part 26, so as to avoid all excess thickness. This proximal extremity portion 40 of the turned-up part 26 forms an extremity peripheral tubular ring 40 extending from the proximal side, and parallel to said tubular principal part of the receiving sleeve 16, when the turned-up part 26 is of 180°. It should be noted that, in a variant (not shown), the turned-up part 26 may be made not at 180° relative to the tubular principal part of the receiving sleeve 16, but according to a turned-up part angle which is greater or less than 180°. However, the turned-up part angle (of the turned-up part 26 relative to the tubular principal part of the receiving sleeve 16) is greater than 120° and less than 240°. The axial height of said proximal extremity portion 40 (in particular the extremity tubular ring 40) is less—in particular much less—than the axial height of the tubular principal part of the receiving sleeve 16. In other words, the proximal extremity of the turned-up part 26 is offset from the distal side relative to the proximal extremity of the tubular principal part of the receiving sleeve 16.

This turned-up part 26, which can be implemented, for example, by pressing, has, between the tubular principal part of the receiving sleeve 16 and the turned-up extremity portion 40 of the proximal side, a curved-back linking portion 80, and this curved-back linking portion has a section in a radial plane which is curved and has continuous curvature, in particular in the general form of an arc of a circle, preferably of a semicircle or U (the linking portion 80 being in the general form of half a torus), or J when the tubular principal part is considered. As a variant, a linking portion 80 having a section of non-constant curvature, e.g. in the general form of a portion of an ellipse or other, can be provided.

This turned-up part 26 thus forms an extremity portion of the receiving sleeve 16 having elasticity in flexion, and thus allowing axial translation movements of the heating rod 11 relative to the fixing ring 15 (and thus relative to the plug body 13) in a sufficiently large amplitude range, and with elastic retraction of the heating rod in axial translation according to a predetermined stiffness coefficient K1, which can be adjusted to a relatively low value by an appropriate choice of the material forming the receiving sleeve 16 and its thickness. Preferably, the receiving sleeve 16, including the turned-up part 26, has approximately constant thickness, e.g. of the order of 0.35 mm.

It should be noted that the turned-up part 26 of the distal extremity of the receiving sleeve 16 has numerous advantages. In particular, such a turned-up part 26 can be implemented simply by pressing. It makes it possible to insert the receiving sleeve via the proximal extremity of the heating rod 11, with no risk of damaging the latter. When deformation occurs, the stresses within the turned-up part 26 are at their maximum value on the proximal side, which is not exposed to the corrosive atmosphere of the combustion chamber. Despite relatively large thickness, in particular of the order of 0.35 mm, a relatively low coefficient of elasticity is obtained, making relatively large movements of the heating rod 11 possible. It also makes it possible to implement a thermally conductive element of small dimensions, and thus of low thermal resistance, between the heating rod 11 and the plug body 13, at the distal extremity of the latter.

The tubular principal part of the receiving sleeve 16 passes axially throughout the length of the fixing ring 15, and extends slightly beyond the proximal extremity 28 of the latter. The cylindrical walls 52, 20 facing them, and the small gap (typically of the order of 0.2 mm) which separates them, as well as the materials forming the receiving sleeve 16 and fixing ring 15, which are metallic and thermally conductive, facilitate thermal exchanges between the proximal portion 50 of the heating rod 11 and the plug body 13 radially, at the level of the receiving sleeve 16 and the fixing ring 15. In other words, a radial thermal bridge is thus implemented by the receiving sleeve 16 and the fixing ring 15. The result, in particular, is that the elements in the receiving housing 14, beyond the receiving sleeve 16 and the fixing ring 15 of the proximal side, including the load sensing sleeve 17 described below, are less exposed to the high temperatures of the heating rod 11 and the combustion chamber.

The proximal extremity 27 of the receiving sleeve 16 comes into contact with a distal extremity 32 of a load sensing sleeve 17, which is tubular overall, and extends axially, in prolongation of the receiving sleeve 16, entirely around the proximal portion 50 (of greater diameter, equal to 4 mm) of the metal tube 59 of the heating rod 11. The load sensing sleeve 17 has symmetry of revolution around the axis 41, and is coaxial to the heating rod 11 and the receiving housing 14. The load sensing sleeve 17 adjoins, axially and directly, the bush 48 for mounting axially on the proximal side.

The load sensing sleeve 17 includes, in the embodiment shown in FIG. 1, a distal ring 31 which is fixed rigidly to the peripheral wall of the receiving sleeve 16 by at least one peripheral weld 53. This distal ring 31 is fitted onto the proximal extremity 27 of the receiving sleeve 16, and has, at its proximal extremity, a radial gap with the peripheral wall of the heating rod 11 (more precisely of the metal tube 59 of the heating rod 11).

The distal extremity 32 of the distal ring 31 forms a first axial extremity of the load sensing sleeve 17, which is connected rigidly to the heating rod 11—more precisely to the metal tube 59 of the heating rod 11—via the receiving sleeve 16. This distal extremity 32 of the load sensing sleeve 17 is thus driven in axial translation by the movements of the heating rod 11 according to the axis 41, at least in the proximal direction, and in the shown embodiments, in both directions.

This distal extremity 32 of the load sensing sleeve 17 is axially at a distance from the proximal extremity 28 of the fixing ring 15, so that it does not come to a limit stop against the latter in the course of axial movements of the heating rod 11. But the distal extremity 32 of the distal ring 31 is as near as possible to the fixing ring 15, so that the load sensing sleeve 17 is directly above the fixing ring 15 on the proximal side.

Above the distal ring 31 (on the proximal side) is a first washer 33 of piezoelectric material, above that is a central washer 34 of electrically conductive material, above that is a second washer 35 of piezoelectric material, and above that is a proximal ring 36.

The various rings and washers 31, 33, 34, 35, 36 of the load sensing sleeve 17 which are stacked in this way have at least approximately the same internal diameter, which is slightly greater than the peripheral diameter of the metal tube 59 of the heating rod 11, so that they do not come into contact with the latter. Their radial thickness is as low as possible, so that they can be accommodated in the receiving housing 14 around the proximal portion 50 of the metal tube 59 of the heating rod 11 (having a peripheral diameter of 4 mm), while nevertheless allowing detection of the axial compression stresses which are generated within the piezoelectric washers 33, 35. Typically, the radial thickness of the piezoelectric washers 33, 35 is of the order of 1 mm.

The proximal ring 36 of the load sensing sleeve 17 has a proximal extremity 37 which also constitutes a second proximal axial extremity of the load sensing sleeve 17. In the embodiment shown in FIG. 1, the proximal extremity 37 of the load sensing sleeve 17 is beyond, on the proximal side, the proximal extremity 38 of the heating rod 11, the heating rod 11 not passing axially entirely through the load sensing sleeve 17. Nevertheless, it should be noted that the load sensing sleeve 17 does not extend entirely around the electrical power supply electrode 12, and is in the most distal possible position within the receiving housing 14 and the proximal side of the mounting bush 48, the latter being at the distal extremity of the receiving housing 14.

The proximal ring 36 of the load sensing sleeve 17 has a radial thickness which is slightly greater than that of the distal ring 31, the central washer 34 and the piezoelectric washers 33, 35. A fine metal linking tube 18 extends around the load sensing sleeve 17 from the proximal ring 36, and on the distal side as far as the fixing ring 15. This linking tube 18 is thus interposed between the load sensing sleeve 17 and the internal wall 44 of the receiving housing 14. The linking tube 18 has a proximal extremity 30 which is fixed rigidly to the proximal ring 36 of the load sensing sleeve 17 by at least one peripheral weld 54, and a distal extremity 29 which is fixed rigidly by at least one peripheral weld 55 to the proximal extremity 28 of the fixing ring 15, preferably in a recess which is made in the wall 19 of the latter and faces radially towards the exterior to avoid any excess thickness. Because of the excess radial thickness of the proximal ring 36 of the load sensing sleeve 17, a radial gap is made between the piezoelectric washers 33, 35, the washer 34 and the distal ring 31 of the load sensing sleeve 17 on the one hand, and the linking tube 18 on the other hand. Similarly, the linking tube 18 is sufficiently fine for a radial gap to be made throughout its axial length, between its cylindrical wall facing the exterior radially and the internal wall 44 of the receiving housing 14 of the plug body 13 facing it. In this way, the linking tube 18 does not come into contact with the plug body 13.

The linking tube 18 thus connects the proximal extremity 37 of the load sensing sleeve 17 to the fixing ring 15, and thus to the plug body 13. But since this link transfers the point of support of the proximal extremity 37 of the load sensing sleeve 17 to the fixing ring 15, the compression stresses which are generated in the load sensing sleeve 17 are in fact representative of the shear loads, which are generated by the axial movements of the heating rod 11, between the proximal portion 50 of the heating rod 11 in contact with the receiving sleeve 16 and the fixing ring 15. Also, since the two axial extremities of the load sensing sleeve 17 rest respectively on the heating rod 11 (more precisely on the metal tube 59 of the heating rod 11) and on the plug body 13, in zones which at least approximately face each other radially, the signals which the load sensor sleeve 17 supplies are not perturbed by deformation of the cylinder head, the plug body 13 or other intermediate elements, except the linking tube as explained below.

The linking tube 18, which is very fine, has some elasticity in axial traction, retracting the proximal extremity 37 of the load sensing sleeve 17 in the distal direction, with a predetermined stiffness coefficient K2, the value of which can be adjusted by an appropriate choice of material forming the linking tube 18 and its dimensions. For example, the linking tube 18 is formed of a material chosen from stainless steels with high characteristics, and its thickness (difference between the radius of its external wall and that of its internal wall) is of the order of 0.2 mm. The linking tube 18 is preferably of stainless steel with high characteristics, having a Young's modulus greater than 150 GPa, in particular of the order of 200 GPa, an elastic limit greater than 600 MPa, e.g. of the order of 800 MPa, and a fatigue strength (maximum stress for which the number of cycles without breakage is infinite) of at least 300 MPa, e.g. of the order of 400 MPa. For example, it is of 17-4PH steel or inconel steel.

Figure 8:
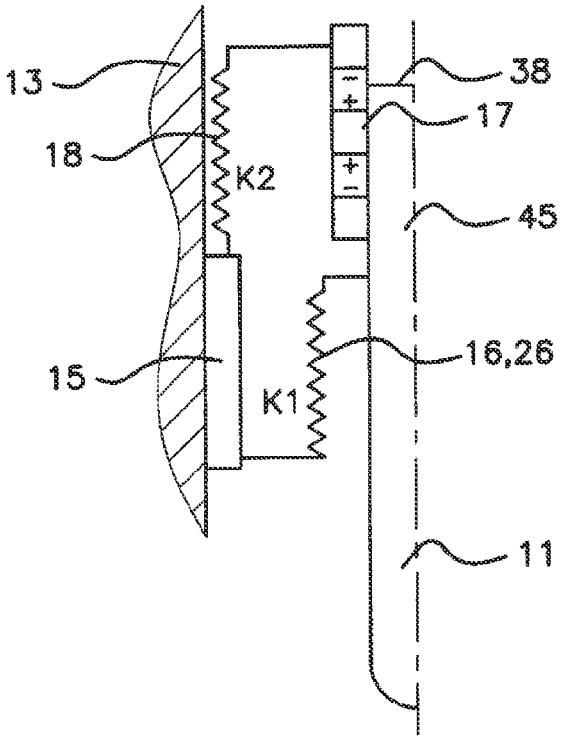
FIG. 8 is a diagram illustrating the functional kinematics of a glow plug according to the invention.

In the embodiments shown in the figures, the proximal extremity 30 of the linking tube 18 is simply welded to the exterior of the proximal extremity 37 of the proximal ring 36 of the load sensing sleeve 17. It should be noted that, to obtain an appropriate value of this stiffness coefficient K2, it is possible to provide a link from the proximal extremity 30 of the linking tube 18 to the proximal ring 36 of the load sensing sleeve 17, with folding forming a turned-up part towards the interior, and on the distal side this turned-up part extending around the proximal extremity 37 of the load sensing sleeve 17, similarly to the turned-up part 26 of the distal extremity of the receiving sleeve 16. The general functional kinematics of a plug according to the invention are shown in the diagram of FIG. 8.

The linking tube 18 also has at least one opening 56, which is made through its whole thickness from its proximal extremity 30 on part of its height, as far as the central washer 34 of the load sensing sleeve 17, so as to allow the passage of an electrical connection pin 57 which is welded to the exterior of the central washer 34 and extends on the proximal side. This electrical connection pin 57 makes it possible to transmit the signals which the piezoelectric washers 33, 35 generate on the proximal side to an electronic circuit 90 for processing the signal which the load sensing sleeve 17 supplies.

Figure 11:
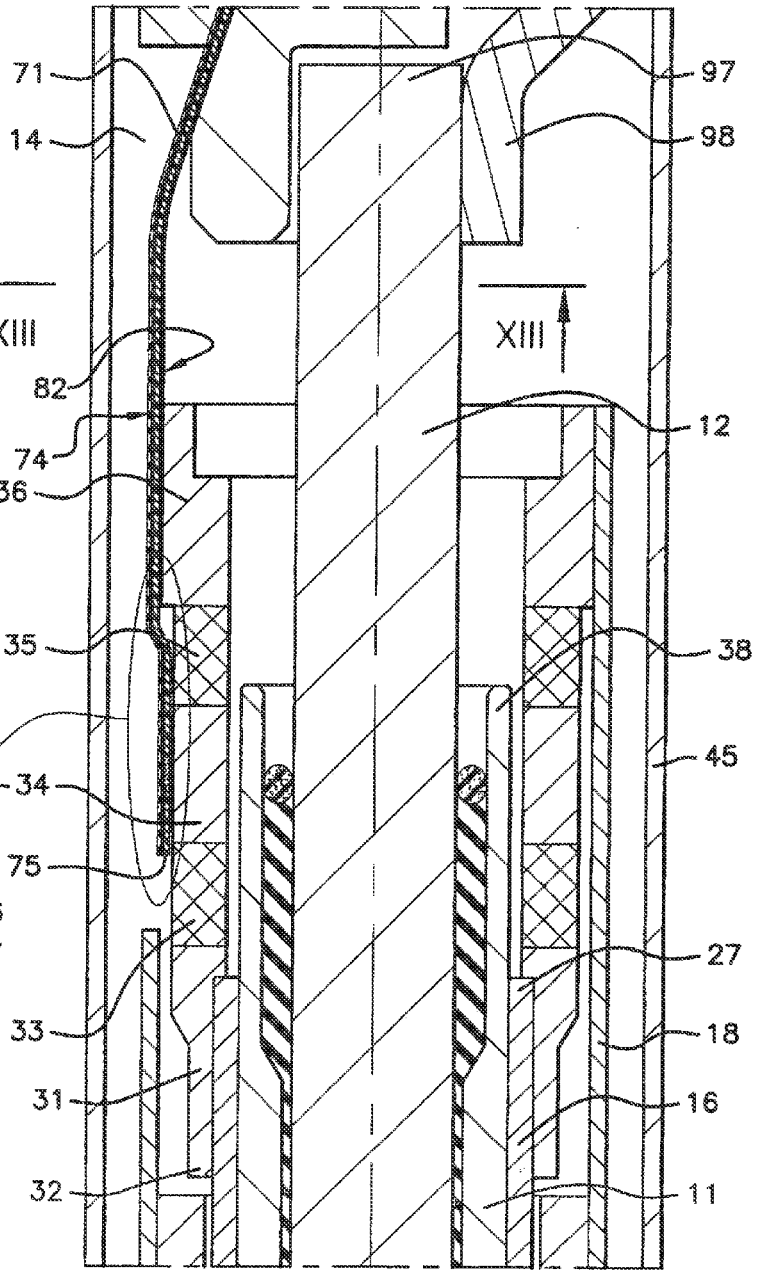
FIG. 11 is a schematic view in axial cross-section of the detail of the electrical connection of the sensor link of a glow plug according to the first embodiment of the invention.
Figure 12:
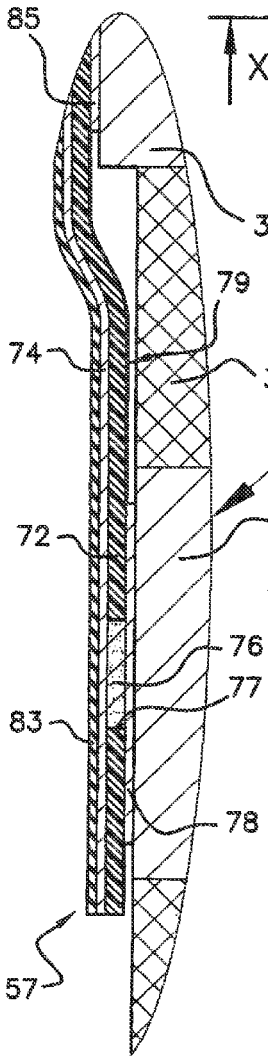
FIG. 12 is a schematic view of a detail of FIG. 11.
Figure 13:
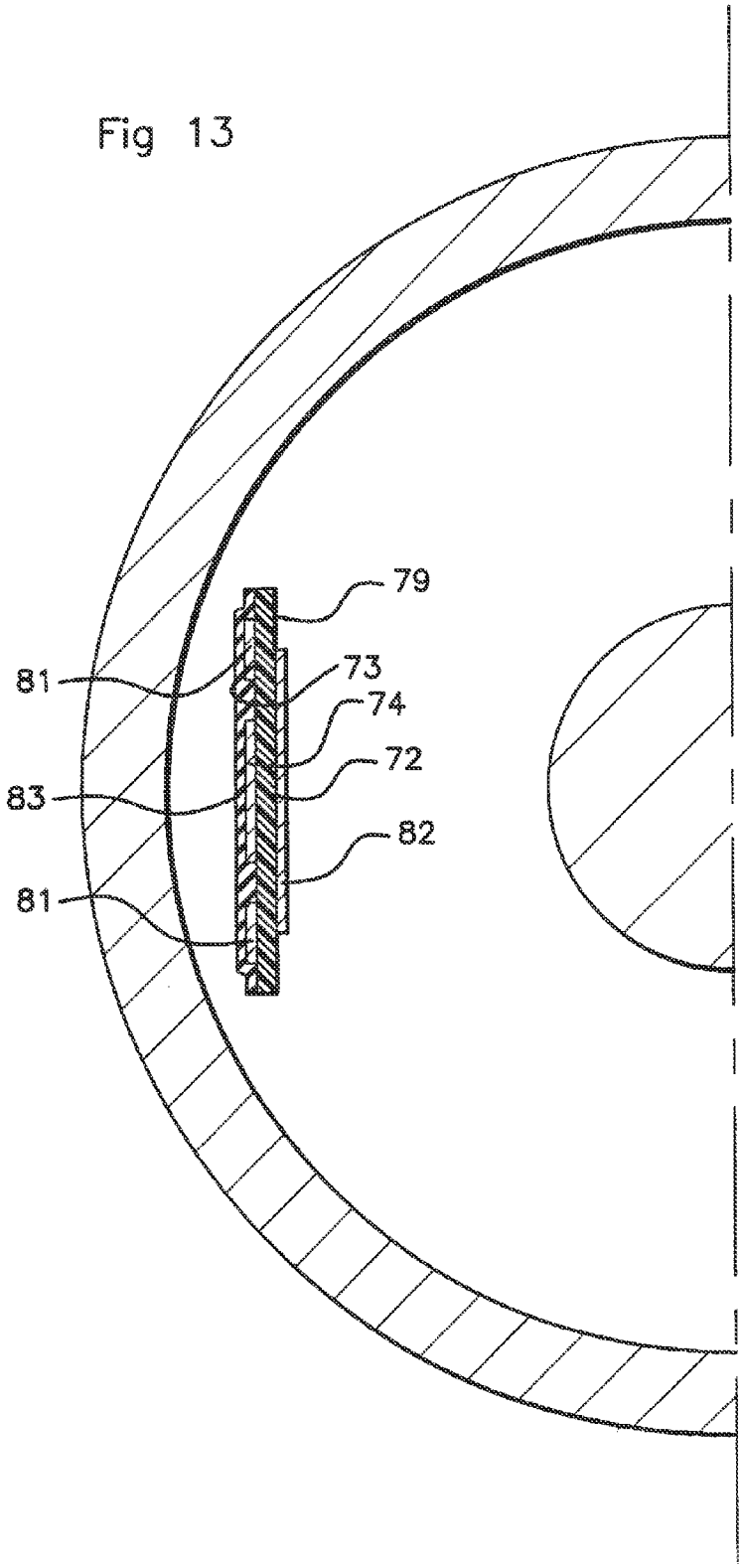
FIG. 13 is a schematic cross-section view according to the line XIII-XIII of FIG. 11.
Figure 14:
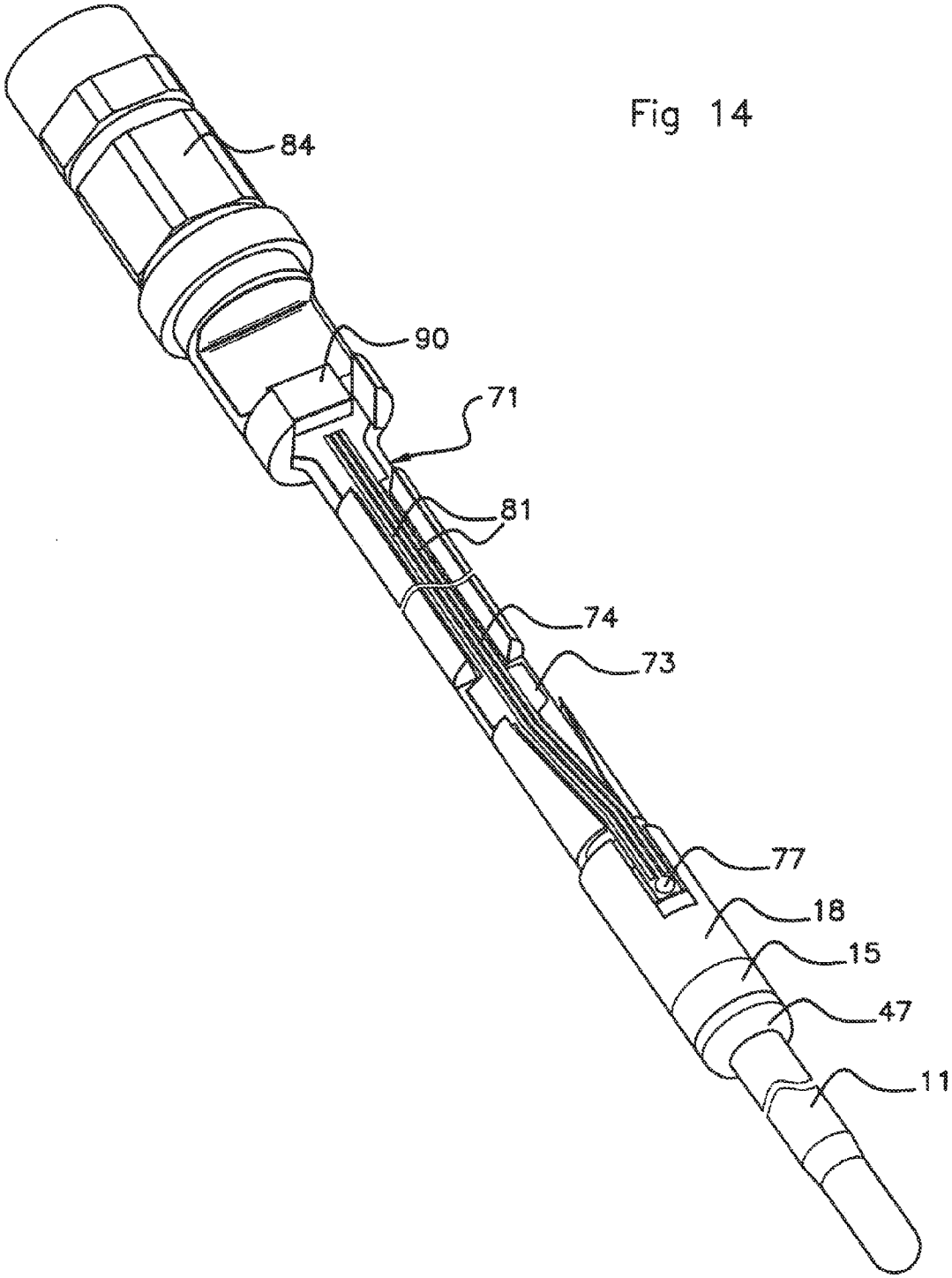
FIG. 14 is a schematic view in partially cut-away perspective of a glow plug according to the first embodiment of the invention, showing in particular the first face facing towards the exterior of the flexible connector which forms the sensor link.
Figure 15:
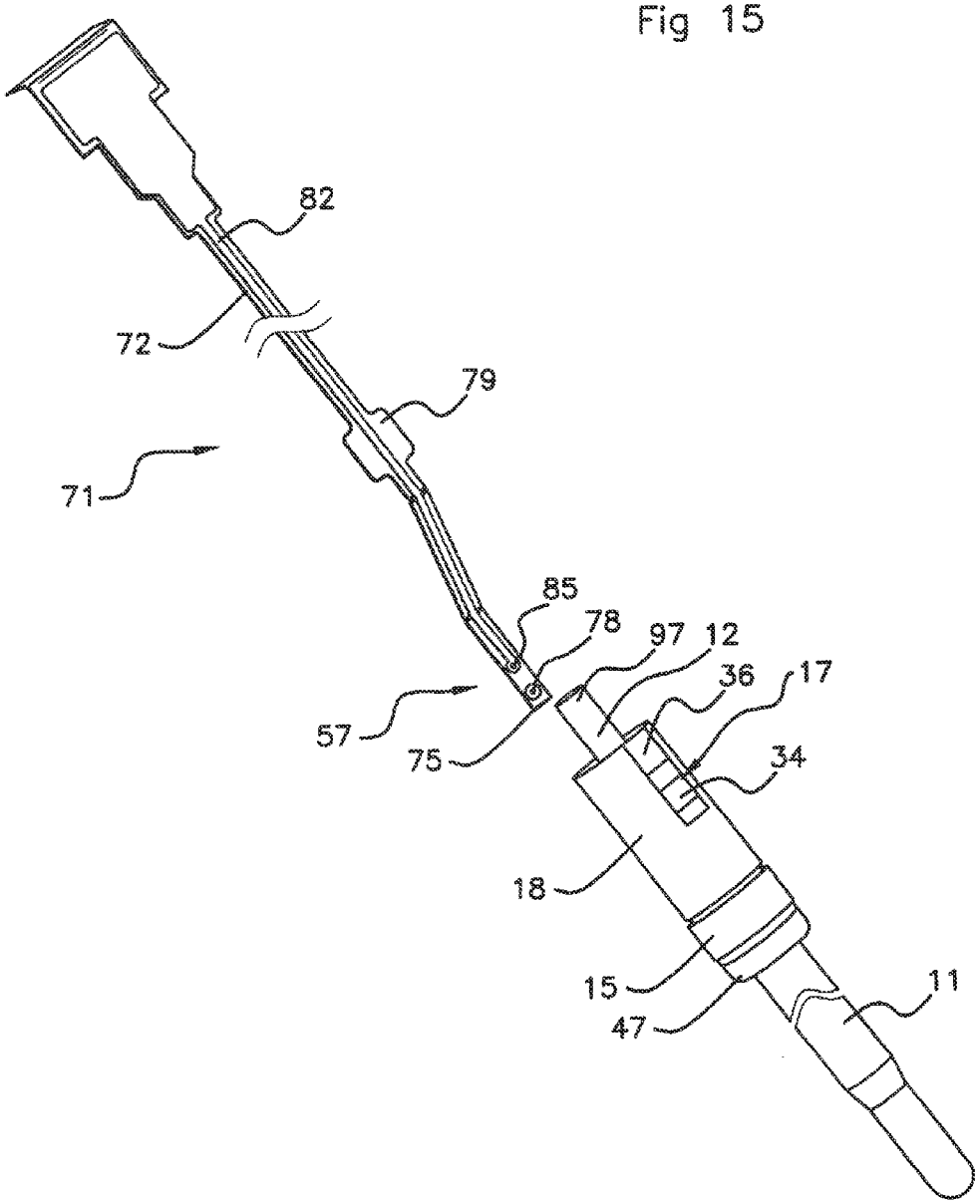
FIG. 15 is a schematic detail view in perspective of the second face, facing towards the interior, of the distal extremity of the flexible connector.

The electrical connection pin 57 is formed at the distal extremity of a flexible connector 71, in the general form of a multilayer band, shown in FIGS. 11 to 13. This connector 71 includes a support layer 72 of an insulating material, which is preferably flexible in flexion and has a first face 73 facing radially towards the exterior of the principal axis 41 of the heating rod, this first face 73 carrying a signal line 74. The signal line is formed of a metallic track (e.g. of copper) which is deposited on said first face 73 and extends longitudinally along the connector, between a distal extremity 75 of the support layer 72 and the electronic circuit 90 for processing the signal which the load sensing sleeve 17 supplies, this electronic processing circuit 90 being carried on a proximal extremity portion of the first face 73. The signal line 74 is connected, via a conductive bushing 77 formed through the thickness of the support layer 72 and at its distal extremity 75, to an extremity stud 78 which is applied on the second face 79, facing radially towards the principal axis 41 of the heating rod, and thus opposite the first face 73 of the support layer 72. The bushing 77 is, for example, filled with conductive adhesive 76. This stud 78, which is of a conductive material (e.g. copper deposited on the face 79) is connected (by welding or a conductive adhesive) to the central washer 34, so that the signal line 74 transmits to the electronic processing circuit 90 the electrical signals which the load sensing sleeve 17 supplies.

The width of the signal line 74 extends only over part of the width of the first face 73, and in the median part of the latter. The first face 73 also carries two conductive earth lines 81 extending along this first face 73 and each side of the signal line 74, and around the bushing 77, so as to form a peripheral screen around this signal line 74. Each conductive earth line 81 is, for example, in the form of a track of conductive material (e.g. copper) which is deposited on the first face 73, and is connected to the electrical earth of the plug body, e.g. at the level of the electronic processing circuit 90. Advantageously, a layer 83 of insulant covers each conductive track (signal line 74 and earth lines 81) which said first face 73 carries, so as to avoid all contact with the internal wall of the plug body facing it. This layer 83 can be in the form of a layer of insulating varnish, which covers the first face 73 entirely.

Said second face 79 of the support layer 72, which faces radially towards the interior, towards the principal axis 41 of the heating rod, carries a conductive earth layer 82. This conductive earth layer 82 is, for example, in the form of a broad track of conductive material which is deposited on the second face 79, at least approximately according to the whole width of the latter, and is connected to the electrical earth of the plug body, e.g. at the level of the electronic processing circuit 90. The width of the support layer 72 as well as the one of the whole flexible connector 71 are offset from the principal axis 41 and extends according a non diametrical cord of the receiving housing. Also, the width of the support layer 72, and thus of the conductive earth layer 82, is as great as possible, in particular greater than that of the signal line 74, and greater than the radius of the cylindrical receiving housing which is formed within the plug body. In this way, the efficiency of the thus formed screening is optimised.

The conductive earth layer 82 is interrupted at its distal extremity 85, at a distance from the stud 78, to avoid any electrical contact with the latter. Preferably, the conductive earth layer 82, on the distal side, does not go beyond the proximal ring 36 of the load sensing sleeve 17. The distal extremity 85 of the conductive earth layer 82 is connected (by welding or a conductive adhesive) to the proximal ring 36 of the load sensing sleeve 17.

The conductive earth layer 82 is thus interposed (radially) between the electrical power supply electrode 12 (axially centered on the principal axis 41) of the heating rod 11 and the signal line 74 for transmitting electrical signals of the load sensing sleeve 17, and thus acts as electrical screening, avoiding all capacitive coupling. Thus the conductive earth layer 82 extends longitudinally along the electrical power supply link of the heating rod and the signal line 74, being arranged between the principal axis 41 and the signal line 74.

The signal line 74 is thus surrounded on all sides by a conductive screen connected to earth: said conductive earth layer 82 forming screening on the interior side, the earth conductive lines 82 forming said peripheral lateral screening, and the metal plug body on the exterior side. The thus formed multilayer flexible connector 71 constitutes an electrical link, called the sensor link 71, extending in the plug body between the load sensor 17 and a proximal portion 84 of the plug body 13, said sensor link 71 being entirely screened.

The electronic processing circuit 90 is advantageously suitable for supplying, on a proximal output terminal of the plug body, a voltage representing the signals supplied by the load sensing sleeve 17, and thus the cylinder pressure. This circuit 90 can be in the form of a charge amplifying integrated circuit. Thus, a glow plug according to the invention constitutes an independent and autonomous unit, which can be manufactured, configured, regulated and certified in the factory, and supplied ready for use on any engine.

Additionally, the plug body 13 consists of multiple distinct metal tubes which are rigidly assembled to extend each other axially, that is a proximal metal tube 95 which is extended axially by the distal metal tube 45. In particular, the proximal tube 95 forms a proximal portion 84 of the plug body 13, which receives the electronic signal processing circuit 90 and various connectors of the glow plug. The threaded portion 43 for mounting the glow plug on the cylinder head of the engine is formed on the external wall of this proximal metal tube 95.

The distal tube 45 has a thickness (difference between its external and internal radii) which is less than that of the proximal tube 95. The proximal tube 95 has, at its distal extremity, a constriction 96 of its external wall forming a recess to receive the proximal extremity of the distal tube 45. Preferably, this receiving constriction 96 has a thickness corresponding to that of the distal tube 45, so that the external walls of the proximal tube 95 and distal tube 45 are continuous with each other at the junction of the two tubes 45, 95, the proximal tube 95 and distal tube 45 both having the same external diameter. The distal tube 45 and proximal tube 95 are joined end to end to each other by laser welding.

The distal tube 45 is made of a first metal alloy, the proximal tube 95 is made of a second metal alloy, and the first metal alloy forming the distal tube 45 has mechanical properties which are superior to those of the second metal alloy forming the proximal tube 95. More particularly, advantageously and according to the invention, the first metal alloy forming the distal tube 45 has a greater elastic limit than that of the second metal alloy forming the proximal tube 95. In particular, advantageously and according to the invention, said metal alloys are chosen to compensate for the reduction of thickness between the proximal tube 95 and the distal tube 45, while providing continuity of the mechanical properties (the elastic limit in particular). Advantageously and according to the invention, the difference of thickness between the distal tube 45 and the proximal tube 95 is such that: $Y1 \times S132\ Y2 \times S2$, where Y1 is the elastic limit of the metal alloy forming the proximal tube, S1 is the section formed by said thickness of the proximal tube, Y2 is the elastic limit of the metal alloy forming the distal tube, and S2 is the section formed by said thickness of the distal tube.

For example, the first metal alloy forming said distal tube 45 is of stainless steel with high characteristics, in particular having a Young's modulus greater than 150 GPa, in particular of the order of 200 GPa, an elastic limit greater than 600 MPa, e.g. of the order of 800 MPa, and a fatigue strength (maximum stress for which the number of cycles without breakage is infinite) of at least 300 MPa, e.g. of the order of 400 MPa. For example, it may be of 17-4PH steel or inconel steel. Advantageously the second metal alloy forming said proximal tube 95 may be a stainless steel for rapid machining, e.g. with an elastic limit of the order of 150 MPa.

Such a distal tube 45 of reduced thickness makes it possible, in particular, to increase the available internal space for forming said receiving housing 14, for the same external diameter and for mechanical properties of the unit of the plug body 13 which are essentially unchanged.

Figure 3:
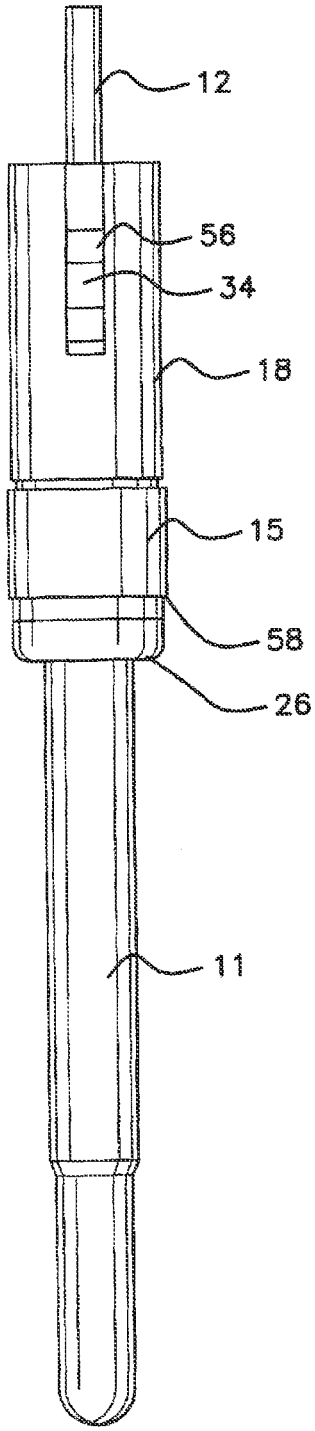
Figure 4:
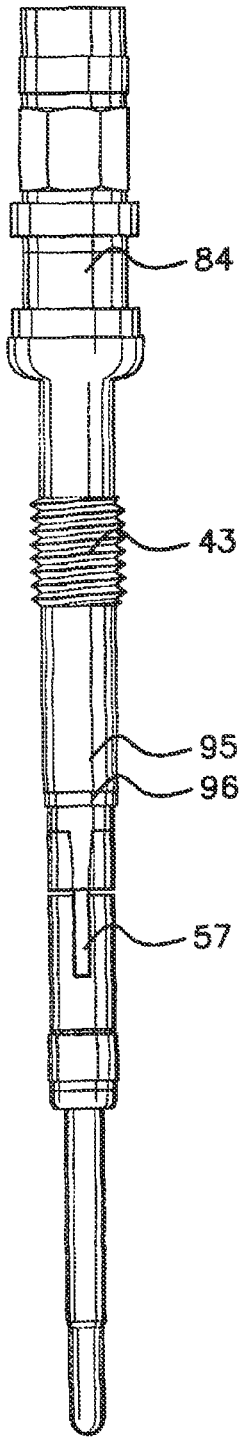

Preferably, at least in this embodiment where the load sensing sleeve 17 includes at least one piezoelectric washer 33, 35, the latter is assembled with a preload in axial compression, e.g. of the order of 100 N, to ensure that each piezoelectric washer 33, 35 is always compressed (by the elastic retractions K1 of the turned-up part 26 and K2 of the linking tube 18, which are prestressed), whatever the axial position of the heating rod 11, including in the case of low pressure in the combustion chamber. Consequently, the load sensing sleeve 17 supplies signals representing the variation of the axial compression stress to which it is subjected in the course of the axial movements of the heating rod 11 relative to the plug body 13. This axial compression preload can be obtained by exerting an axial compression load between the fixing ring 15 (which has a shoulder 58 extending radially towards the exterior and facing towards the distal side) and the proximal extremity 30 of the linking tube 18, at the instant of executing the peripheral weld 55 of the distal extremity 29 of the linking tube 18 onto the proximal extremity 28 of the fixing ring 15 (FIG. 3).

FIGS. 2 to 5 show different stages of a process for manufacturing a glow plug according to the first embodiment of the invention.

Figure 5:
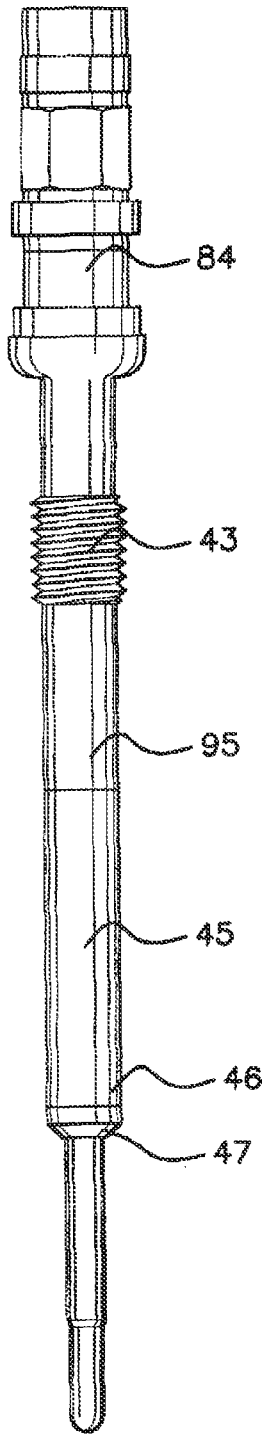

First the receiving sleeve 16 is fixed around the heating rod 11 by peripheral welding, then the fixing ring 15 is inserted and fixed around the receiving sleeve 16, in the turned-up part 26, by peripheral welding. Then the load sensing sleeve 17 is introduced via the proximal extremity 38 of the heating rod 11 (FIG. 2), until it comes against the proximal extremity of the receiving sleeve 16. The peripheral weld 53 of the distal ring 31 of the load sensing sleeve 17 onto the receiving sleeve 16 is executed. Then the linking tube 18 is introduced, via the proximal extremity 38 of the heating rod 11, around the load sensing sleeve 17. Then the peripheral weld of the proximal extremity 30 of the linking tube 18 onto the proximal extremity 37 of the load sensing sleeve 17 is executed. Then, by axial compression (of the order of 100 N), the peripheral weld of the distal extremity 29 of the linking tube 18 onto the proximal extremity 28 of the fixing ring 15 is executed (FIG. 3). Then the electrical connections of the heating rod 11 (via the electrode 12) and load sensing sleeve 17 (via the pin 57) are executed, and the various elements in the proximal portion of the glow plug (FIG. 4) are assembled. Then, via the distal extremity of the heating rod 11, the distal tube 45 of the plug body 13, which forms the receiving housing 14, is inserted, then the truncated distal extremity washer 47, and the whole is fixed by peripheral welding (FIG. 5).

When the cylinder pressure increases, the heating rod 11 moves slightly axially in translation in the proximal direction, which compresses the load sensing sleeve 17, the piezoelectric washers 33, 35 of which supply the electrical charges representing this compression.

The turned-up part 26 of the distal extremity of the receiving sleeve 16 retracts the heating rod 11 of the distal side against the cylinder pressure, according to the stiffness coefficient K1. This retraction makes it possible to reduce, for the same value of pressure increase, the compression stresses to which the load sensing sleeve 17 is subjected, which increases its working range. It also makes it possible to limit the stresses to which the linking tube 18 is subjected.

The elasticity of the linking tube 18, according to the stiffness coefficient K2, makes it possible to reduce, on the one hand, the load to which the load sensing sleeve 17 is subjected for the same cylinder pressure, and on the other hand the compression stresses to which the turned-up part 26 is subjected. The greater the value of the stiffness coefficient K2, the greater is the stress to which the load sensing sleeve 17 is subjected (for the same cylinder pressure). Also, the elasticity of the linking tube 18 according to the stiffness K2 makes it possible to retain an impermeability membrane (formed by the turned-up part 26) of sufficient thickness (in particular of the order of 0.35 mm), to the advantage of good disposal of calories by thermal conduction via this impermeability membrane, while avoiding this impermeability membrane being subjected to excessive stresses (at the risk of causing deformations in plasticity or deterioration of the membrane) under the effect of differential thermal expansion.

Also, if the linking tube 18 and receiving sleeve 16 are made of the same material, or of materials having the same thermal characteristics, this compensates for the variations of the stiffness coefficients K1 and K2 as a function of temperature. Advantageously and according to the invention, the linking tube 18 and the receiving sleeve 16 consist of the same material, which is chosen from the stainless steels, preferably stainless steels of high characteristics, in particular high elastic limit and high fatigue strength. In particular, advantageously and according to the invention, the linking tube 18 and the receiving sleeve 16 are made the same, of stainless steel with high characteristics, in particular having a Young's modulus greater than 150 GPa, in particular of the order of 200 GPa, an elastic limit greater than 600 MPa, e.g. of the order of 800 MPa, and a fatigue strength (maximum stress for which the number of cycles without breakage is infinite) of at least 300 MPa, e.g. of the order of 400 MPa. For example, they are both of 17-4PH steel or inconel steel.

The choice of the two stiffness coefficients K1 and K2 makes it possible to adjust the pass band of the thus formed mechanical system, e.g. so that it has a first normal mode (fundamental or natural frequency) with axial oscillations greater than 10 kHz. For example, it has been possible to obtain good results with K1=K2≈40 N/μm.

As is seen, a glow plug of standard dimensions is obtained, incorporating a load sensor which supplies signals representing the cylinder pressure in a perfectly reliable and precise manner, not perturbed by the normal modes of deformation of the heating rod 11 or of the electrical power supply electrode 12, or by deformation of the plug body 13 or cylinder head. In practice, it is noticed that the load sensing sleeve 17 is not subjected to temperatures greater than 170° C.

Figure 7:
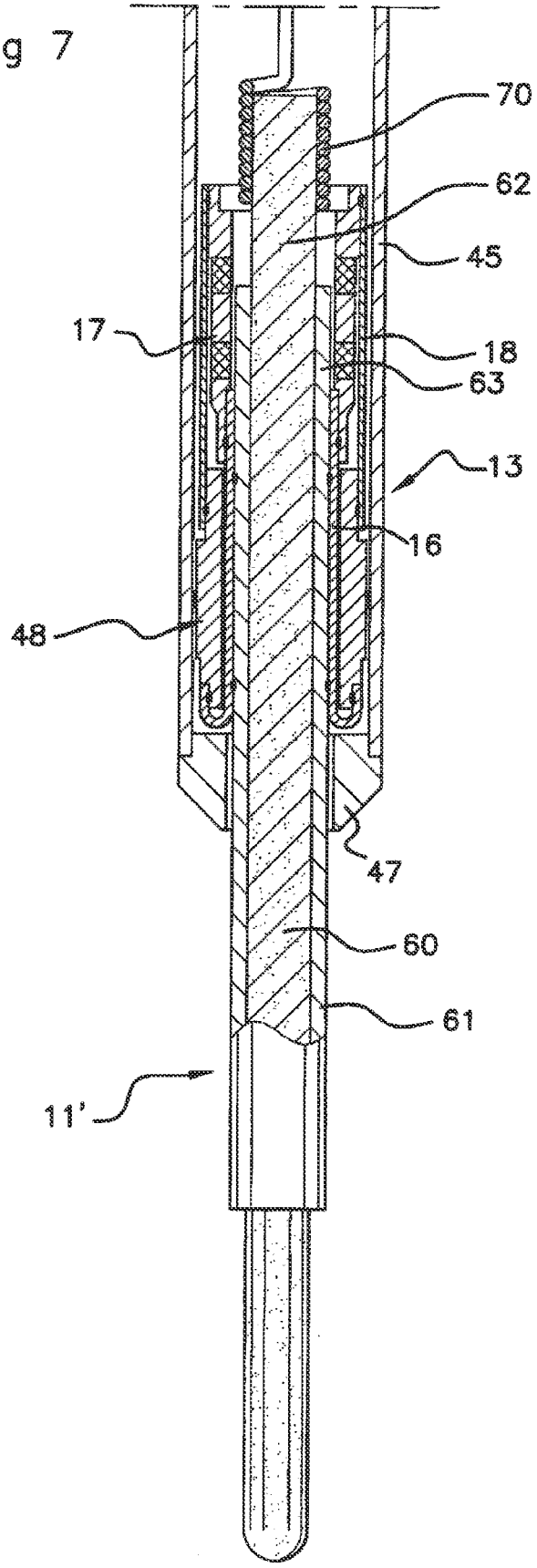
FIG. 7 is a schematic view in axial cross-section of the distal part of a glow plug according to a second embodiment of the invention.
Figures 9, 10:
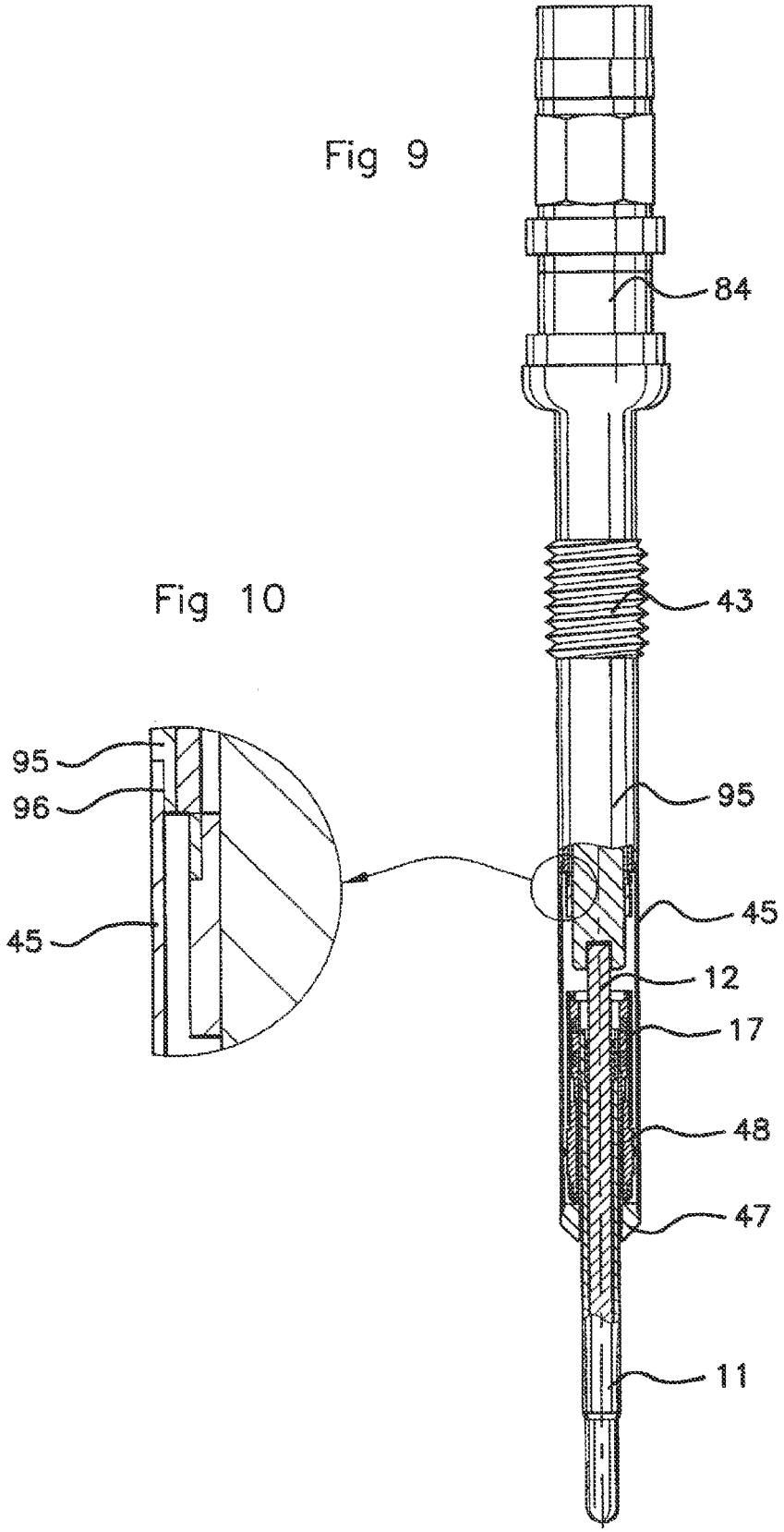
FIG. 9 is a schematic view in partial axial cross-section of a glow plug according to the first embodiment of the invention.
FIG. 10 is a view of a detail of FIG. 9.

In the second embodiment shown in FIG. 7, the heating rod 11' is not in the form of a simple metal tube, but of a ceramic bar 60 which is set (and fixed by brazing or bracing, i.e. inserted by force with a residual elastic radial stress) into a peripheral metal tube 61 forming the peripheral wall of the heating rod 11' and the section, of diameter equal to 4 mm, of the heating rod 11'. The peripheral metal tube 61 extends axially not only in the receiving housing 14, but also beyond the washer 47 and plug body 13, partly forming the distal portion of the heating rod 11'. The ceramic bar 60 goes axially beyond the peripheral metal tube 61 at both its proximal extremity and its distal extremity. The ceramic bar 60 also incorporates, in a way which is known per se, a resistive component which is supplied with electric current and heats by Joule effect.

The load sensing sleeve 17 then also extends around the heating rod 11', i.e. around the proximal portion 63 of the metal tube 61 and the proximal portion 62 of the ceramic bar 60, in the most distal possible position in the receiving housing 14, directly axially adjoining the fixing ring 15, and thus the mounting bush 48, of the proximal side. In this second shown embodiment, the load sensing sleeve 17 extends slightly beyond the proximal extremity of the peripheral tube 61 of the heating rod 11'. Nevertheless, on the proximal side the load sensing sleeve 17 does not go beyond the proximal extremity of the heating rod 11', which consists of the proximal extremity of the ceramic bar 60. The electrical power supply of such a heating rod is implemented as a winding 70 of a conductive wire which is wound around the proximal extremity of the ceramic bar 60, in electrical contact with the latter. Otherwise, the second embodiment is identical to the first embodiment.

As is seen, the invention is as compatible with a heating rod 11 in the form of a metal tube 59, as with a heating rod 11' in the form of a ceramic bar 60 set in a peripheral metal tube 61.

Figure 6:
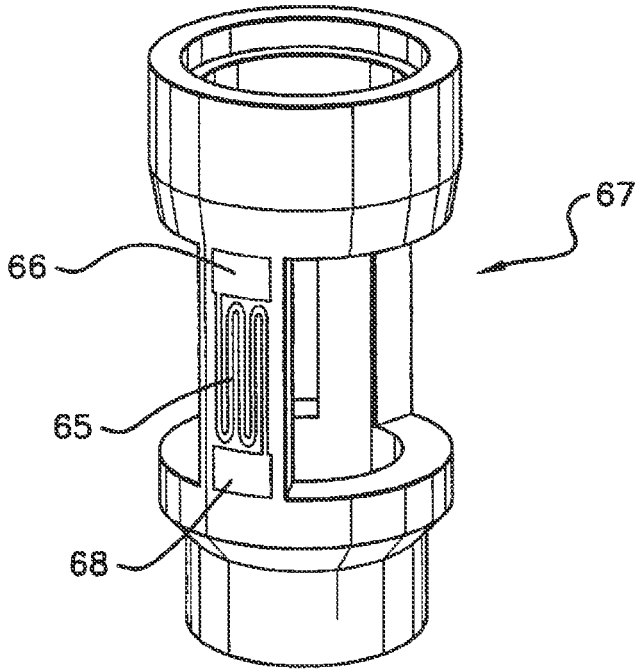
FIG. 6 is a schematic view in perspective of a load sensing sleeve according to a variant embodiment conforming to the invention.

FIG. 6 shows a variant embodiment of a load sensor sleeve 67 which can be used in a glow plug according to the invention. In this variant, the load sensor sleeve 67 does not include piezoelectric washers, but at least one stress gauge 65 (coiled wire, the electrical resistance of which varies as a function of the deformation), the terminals 68 and 66 of which are connected to an electrical connection pin like the pin 57 described above. In this variant embodiment, the load sensor sleeve 67 can function equally well in axial compression and traction.

The invention can be the subject of numerous variants in relation to the embodiments described above and shown in the figures. In particular, the load sensing sleeve 17 can include a single piezoelectric washer or more than two piezoelectric washers, the proximal extremity of the load sensing sleeve 17 can be welded directly onto the heating rod, etc. Also, it is possible to provide that the axial extremity of the load sensing sleeve connected to the heating rod is its proximal extremity (and not its distal extremity), the distal extremity of the load sensing sleeve being connected to the plug body. The welds can be implemented by laser welding or otherwise.

The invention claimed is:

1. A glow plug, comprising:

a heating rod (11, 11') comprising a peripheral metal tube (59, 61), and having an extremity, called the proximal extremity (38), which is equipped with an electrical power supply connection of the heating rod, a plug body (13), forming a housing, called a receiving housing (14), receiving the heating rod, the heating rod having a distal portion which distally extends axially, projecting beyond the plug body, a mounting device (48) for mounting the heating rod in said receiving housing (14), the mounting device being arranged to:

permit axial translation movements of the heating rod relative to the plug body, and ensure impermeability between the heating rod and the plug body, in such a way as to delimit a proximal zone (51) of the receiving housing extending towards the proximal extremity, said proximal zone not being exposed to the atmosphere of a combustion chamber of an engine which receives the glow plug, a load sensing sleeve (17, 67) which extends entirely in said proximal zone of the receiving housing, said load sensing sleeve being tubular and having:

a first axial extremity (32), which is connected to the heating rod so as to be driven in axial translation by the movements of the heating rod in at least one direction, called the proximal direction, in which the heating rod tends to re-enter the interior of the plug body, and a second axial extremity (37), opposite the first axial extremity, this second axial extremity being connected to the plug body in such a way that the axial translation movements of the heating rod relative to the plug body generate axial compression stresses and axial traction stresses in said load sensing sleeve, wherein, said tubular load sensing sleeve (17, 67) extends around a portion, called the proximal portion (50, 63), of the peripheral metal tube (59, 61) of the heating rod (11, 11'), said proximal portion of the peripheral metal tube of the heating rod, around which the load sensing sleeve extends, also extends in said proximal zone (51) of the receiving housing (14), and the tubular load sensing sleeve (17, 67) directly adjoins the mounting device (48) axially on the proximal side thereof extending towards the proximal extremity.

2. The glow plug according to claim 1, wherein the heating rod (11') being formed of a ceramic bar (60) which is set in a peripheral metal tube (61), said load sensing sleeve (17, 67) extends around the proximal portion (63) of the peripheral metal tube of the heating rod.

3. The glow plug according to claim 1, wherein the heating rod (11) being essentially in the form of a metal tube, said load sensing sleeve (17, 67) extends around the proximal portion (50) of this metal tube.

4. The glow plug according to claim 1, wherein said mounting device includes a mounting bush (48) which is fixed in said receiving housing (14) and around said proximal portion (50, 63) of the peripheral metal tube (59, 61) of the heating rod, and the load sensing sleeve (17, 67) is carried by said mounting bush (48).

5. The glow plug according to claim 4, wherein the mounting bush (48) has a first fixing face (19) which is fixed rigidly and impermeably to an internal wall (44) facing the receiving housing (14), and a second fixing face (22) which is fixed rigidly and impermeably around said proximal portion (50, 63) of the heating rod, and said first (19) and second (22) fixing faces of the mounting bush at least partially face each other radially.

6. The glow plug according to claim 5, wherein said load sensing sleeve (17, 67) extends axially beyond said fixing faces (19, 22) of the mounting bush (48), towards the proximal extremity of the heating rod.

7. The glow plug according to claim 1, wherein said first axial extremity (32) of the load sensing sleeve is a distal extremity of the load sensing sleeve, and said second axial extremity (37) of the load sensing sleeve is a proximal extremity of the load sensing sleeve.

8. The glow plug according to claim 4, wherein the mounting bush (48) includes a linking tube (18) which surrounds the load sensing sleeve (17, 67) and links said second axial extremity (37) of the load sensing sleeve to said first fixing face (19).

9. The glow plug according to claim 8, wherein the mounting bush (48) includes a receiving sleeve (16) for receiving the heating rod which forms said second fixing face (22), and a fixing ring (15) which forms said first fixing face (19), said receiving sleeve (16) being guided in axial translation in the fixing ring, the receiving sleeve being connected to a distal extremity (25) of the fixing ring.

10. The glow plug according to claim 9, wherein the linking tube (18) is connected to a proximal extremity (28) of the fixing ring.

11. The glow plug according to claim 1, wherein the load sensing sleeve (17, 63) is in the form of a tubular block, and the heating rod (11, 11') passes axially through the mounting bush (48) entirely, and at least partially through the load sensing sleeve (17, 63).

12. The glow plug according to claim 1, wherein the load sensing sleeve includes at least one washer of a piezoelectric material.

13. The glow plug according to claim 2, wherein said mounting device includes a mounting bush (48) which is fixed in said receiving housing (14) and around said proximal portion (50, 63) of the peripheral metal tube (59, 61) of the heating rod, and the load sensing sleeve (17, 67) is carried by said mounting bush (48).

14. The glow plug according to claim 3, wherein said mounting device includes a mounting bush (48) which is fixed in said receiving housing (14) and around said proximal portion (50, 63) of the peripheral metal tube (59, 61) of the heating rod, and the load sensing sleeve (17, 67) is carried by said mounting bush (48).

15. The glow plug according to claim 2, wherein said first axial extremity (32) of the load sensing sleeve is a distal extremity of the load sensing sleeve, and said second axial extremity (37) of the load sensing sleeve is a proximal extremity of the load sensing sleeve.

16. The glow plug according to claim 3, wherein said first axial extremity (32) of the load sensing sleeve is a distal extremity of the load sensing sleeve, and said second axial extremity (37) of the load sensing sleeve is a proximal extremity of the load sensing sleeve.

17. The glow plug according to claim 9, wherein the linking tube (18) is connected to a proximal extremity (28) of the fixing ring.

18. The glow plug according to claim 1, wherein said peripheral metal tube axially extends proximally in said receiving housing, distally beyond the mounting device, and distally beyond a distal extremity of the plug body, said peripheral metal tube at least partly forming said distal portion of the heating rod.

19. A glow plug, comprising:

a heating rod (11, 11') comprised of a peripheral metal tube (59, 61) with i) a the proximal extremity (38) equipped with an electrical power supply connection and ii) a distal portion which distally extends axially;

a plug body (13) that forms a receiving housing (14), the heating rod received in the receiving housing, the distal portion of the heating rod having distally extends axially and projecting beyond the plug body;

a mounting device (48) that mounts the heating rod in said receiving housing (14), the mounting device i) permitting axial translation movements of the heating rod relative to the plug body, and ii) ensuring impermeability between the heating rod and the plug body, and delimiting a proximal zone (51) of the receiving housing that extends towards the proximal extremity, said proximal zone not being exposed to the atmosphere of a combustion chamber of an engine which receives the glow plug;

a load sensing sleeve (17, 67) which extends entirely in said proximal zone of the receiving housing, said load sensing sleeve being tubular and having i) a first axial extremity (32) connected to the heating rod so as to be driven in axial translation by the movements of the heating rod in at least a proximal direction in which the heating rod tends to re-enter the interior of the plug body, and ii) a second axial extremity (37), opposite the first axial extremity, the second axial extremity being connected to the plug body such that the axial translation movements of the heating rod relative to the plug body generate axial compression stresses and axial traction stresses in said load sensing sleeve, wherein, said tubular load sensing sleeve (17, 67) extends around a proximal portion (50, 63) of the peripheral metal tube (59, 61) of the heating rod (11, 11'), said proximal portion of the peripheral metal tube of the heating rod, around which the load sensing sleeve extends, also extends in said proximal zone (51) of the receiving housing (14), and the tubular load sensing sleeve (17, 67) directly adjoins the mounting device (48) axially on the proximal side thereof extending towards the proximal extremity.

20. The glow plug according to claim 19, wherein said peripheral metal tube axially extends proximally in said receiving housing, distally beyond the mounting device, and distally beyond a distal extremity of the plug body, said peripheral metal tube at least partly forming said distal portion of the heating rod.

* * * * *